US009625869B2

(12) United States Patent
Noguchi et al.

(10) Patent No.: US 9,625,869 B2
(45) Date of Patent: Apr. 18, 2017

(54) IMAGE FORMING APPARATUS WITH A CONTROLLER FOR FORMING A TONER PATCH

(71) Applicant: Konica Minolta, Inc., Chiyoda-ku, Tokyo (JP)

(72) Inventors: Hidetoshi Noguchi, Tahara (JP); Kazutoshi Kobayashi, Toyokawa (JP); Tomohisa Yoshida, Toyokawa (JP); Kazuya Kitamura, Nagoya (JP); Ryohei Matsuo, Toyokawa (JP)

(73) Assignee: KONICA MINOLTA, INC, Chiyoda-Ku, Tokyo (JP)

( * ) Notice: Subject to any disclaimer, the term of this patent is extended or adjusted under 35 U.S.C. 154(b) by 0 days.

(21) Appl. No.: 14/986,782

(22) Filed: Jan. 4, 2016

(65) Prior Publication Data

US 2016/0195843 A1 Jul. 7, 2016

(30) Foreign Application Priority Data

Jan. 5, 2015 (JP) ..... 2015-000307

(51) Int. Cl.
*G03G 21/00* (2006.01)
*G03G 15/08* (2006.01)

(52) U.S. Cl.
CPC ..... *G03G 21/00* (2013.01); *G03G 21/0005* (2013.01); *G03G 21/0094* (2013.01); *G03G 15/0893* (2013.01)

(58) Field of Classification Search
CPC . G03G 21/00; G03G 21/0005; G03G 21/0094
(Continued)

(56) References Cited

U.S. PATENT DOCUMENTS 8,116,646 B2 * 2/2012 Akiyama ..... G03G 15/0131 399/49
2011/0268463 A1 * 11/2011 Kimura ..... G03G 21/0005 399/53

FOREIGN PATENT DOCUMENTS

JP 2001-312132 A 11/2001
JP 2007-187734 A 7/2007
(Continued)

OTHER PUBLICATIONS

Office Action (Notice of Reasons for Refusal) issued on Jan. 10, 2017, by the Japanese Patent Office in corresponding Japanese Patent Application No. 2015-000307 and English Translation of the Office Action. (8 pages).

*Primary Examiner* — Quana M Grainger
(74) *Attorney, Agent, or Firm* — Buchanan Ingersoll & Rooney PC

(57) ABSTRACT

An image forming apparatus having: an image supporting member; an electrostatic latent image forming section; and a developing device. In the developing device, a supply member receives toner, polish and antifriction at a supply part. The supply member supplies the toner, the polish and the antifriction to a developing roller while conveying the toner, the polish and the antifriction in a predetermined direction along a rotation axis of the image supporting member. A developing roller develops an electrostatic latent image by supplying the toner, the polish and the antifriction to the image supporting member. A toner patch is formed on the image supporting member, in a facing area capable of facing the developing roller, such that the amount of toner adhering to the image supporting member decreases with increasing distance in the predetermined direction from the supply part. A cleaner removes the toner patch from the image supporting member.

9 Claims, 9 Drawing Sheets

(58) Field of Classification Search
USPC ..... 399/72
See application file for complete search history.

(56) References Cited

FOREIGN PATENT DOCUMENTS

| | | | |
|---|---|---|---|
| JP | 2012-203378 | A | 10/2012 |
| JP | 2014-219484 | A | 11/2014 |

* cited by examiner

8

PRIOR ART

IMAGE FORMING APPARATUS WITH A CONTROLLER FOR FORMING A TONER PATCH

This application claims benefit of priority to Japanese Patent Application No. 2015-000307 filed Jan. 5, 2015, the entire content of which is incorporated herein by reference.

BACKGROUND OF THE INVENTION

1. Filed of the Invention

The present invention relates to an image forming apparatus, and more particularly to an image forming apparatus configured to form toner images.

2. Description of Related Art

As an example of the past inventions relating to image forming apparatuses, for example, a developing device disclosed in Japanese Patent Laid-Open Publication No. 2001-312132 is known. Toner used in the developing device contains silica microparticles, strontium titanate and stearate as additives. The silica microparticles serve as mobile microparticles to heighten the fluidity of toner, and the strontium titanate serves as a polish. The stearate serves as an antifriction to prevent the silica microparticles from adhering to the surface of an image supporting member.

The developing device disclosed in Japanese Patent Laid-Open Publication No. 2001-312132 has a problem of causing the image supporting member to have a non-uniform film thickness in the main-scanning direction accompanied with use. FIG. 10 is a graph indicating the relation between the coefficient of friction and the point on the image supporting member. FIG. 11 is a graph indicating the relation between the film thickness and the point on the image supporting member. In FIG. 10, the y-axis indicates the coefficient of friction, and the x-axis indicates the point on the image supporting member in the main-scanning direction. In FIG. 11, the y-axis indicates the film thickness, and the x-axis indicates the point on the image supporting member in the-main scanning direction.

A developer is contained in the developing device, and the developer consists of toner particles and carrier particles, and further contains silica microparticles, strontium titanate and stearate as additives. The developing device has a first stirring/conveying member, a second stirring/conveying member and a developer supply member. The first stirring/conveying member and the second stirring/conveying member extend in the main-scanning direction. The first and second stirring/conveying members circulate the developer in the developing device while stirring the developer. The developer supply member is arranged to face the first stirring/conveying member. The developer supply member receives the developer from the first stirring/conveying member and develops an electrostatic latent image on the image supporting member with toner.

In the developing device, stearate separates from toner particles more easily than strontium titanate. Accordingly, while the developer is conveyed by the first stirring/conveying member, a large amount of stearate separates from toner particles around the upstream portion, with respect to the developer conveying direction, of the first stirring/conveying member. Therefore, the developer supported by the upstream portion, with respect to the developer conveying direction, of the developer supply member contains a relatively large amount of stearate. On the other hand, the developer supported by the downstream portion, with respect to the developer conveying direction, of the developer supply member contains a relatively small amount of stearate. Thus, the upstream portion of the developer supply member supplies toner containing a relatively large amount of stearate to the image supporting member, and the downstream portion of the developer supply member supplies a relatively small amount of stearate to the image supporting member.

When a relatively large amount of stearate adheres to the image supporting member, the coefficient of friction of the image supporting member is relatively high, and when a relatively small amount of stearate adheres to the image supporting member, the coefficient of friction of the image supporting member is relatively low. Therefore, as seen in FIG. 10, the coefficient of friction of the image supporting member in the upstream portion with respect to the developer conveying direction is relatively low, and the coefficient of friction of the image supporting member in the downstream portion with respect to the developer conveying direction is relatively high. At a time of cleaning the image supporting member with a cleaner blade, the cleaner blade scrapes the surface of the image supporting member more in the portion having a higher coefficient of friction. Therefore, with the developing device disclosed in Japanese Patent Laid-Open Publication No. 2001-312132, in the upstream portion with respect to the developer conveying direction, the surface of the image supporting member is not scraped much, and accordingly, the film thickness of the upstream portion of the image supporting member becomes relatively thicker. In the downstream portion with respect to the developer conveying direction, the surface of the image supporting member is scraped much, and accordingly, the film thickness of the upstream portion of the image supporting member becomes relatively thinner. Thus, the film thickness of the image supporting member becomes non-uniform in the main-scanning direction accompanied with use.

SUMMARY OF THE INVENTION

An object of the present invention is to provide an image forming apparatus that can reduce the risk that the film thickness of an image supporting member might become non-uniform.

An image forming apparatus according to an embodiment of the present invention comprises: an image supporting member configured to rotate on a rotation axis extending in a predetermined direction; an electrostatic latent image forming section configured to form an electrostatic latent image on the image supporting member; a developing device including a body, a developing roller facing the image supporting member, and a supply member facing the developing roller, the body containing toner, a polish serving to polish the image supporting member and an antifriction serving to lower a coefficient of friction of the image supporting member; a cleaner; and a controller, wherein: in the body of the developing device, a supply part where the toner, the polish and the antifriction are supplied to the supply member is provided; the supply member supplies the toner, the polish and the antifriction the supply member received at the supply part to the developing roller while conveying the toner, the polish and the antifriction in the predetermined direction; the developing roller develops the electrostatic latent image by supplying the toner, the polish and the antifriction received from the supply member to the image supporting member; the controller drives the electrostatic latent image forming section and the developing device to form a toner patch on the image supporting member, in a facing area capable of facing the developing roller, such that an amount of toner adhering to the image supporting member decreases with increasing distance in the predetermined direction from a predetermined point closest to the supply part with respect to the predetermined direction; and the cleaner removes the toner patch from the image supporting member.

DETAILED DESCRIPTION OF THE PREFERRED EMBODIMENTS

An image forming apparatus according to an embodiment will hereinafter be described with reference to the drawings.

Structure of Image Forming Apparatus

Figure 1:
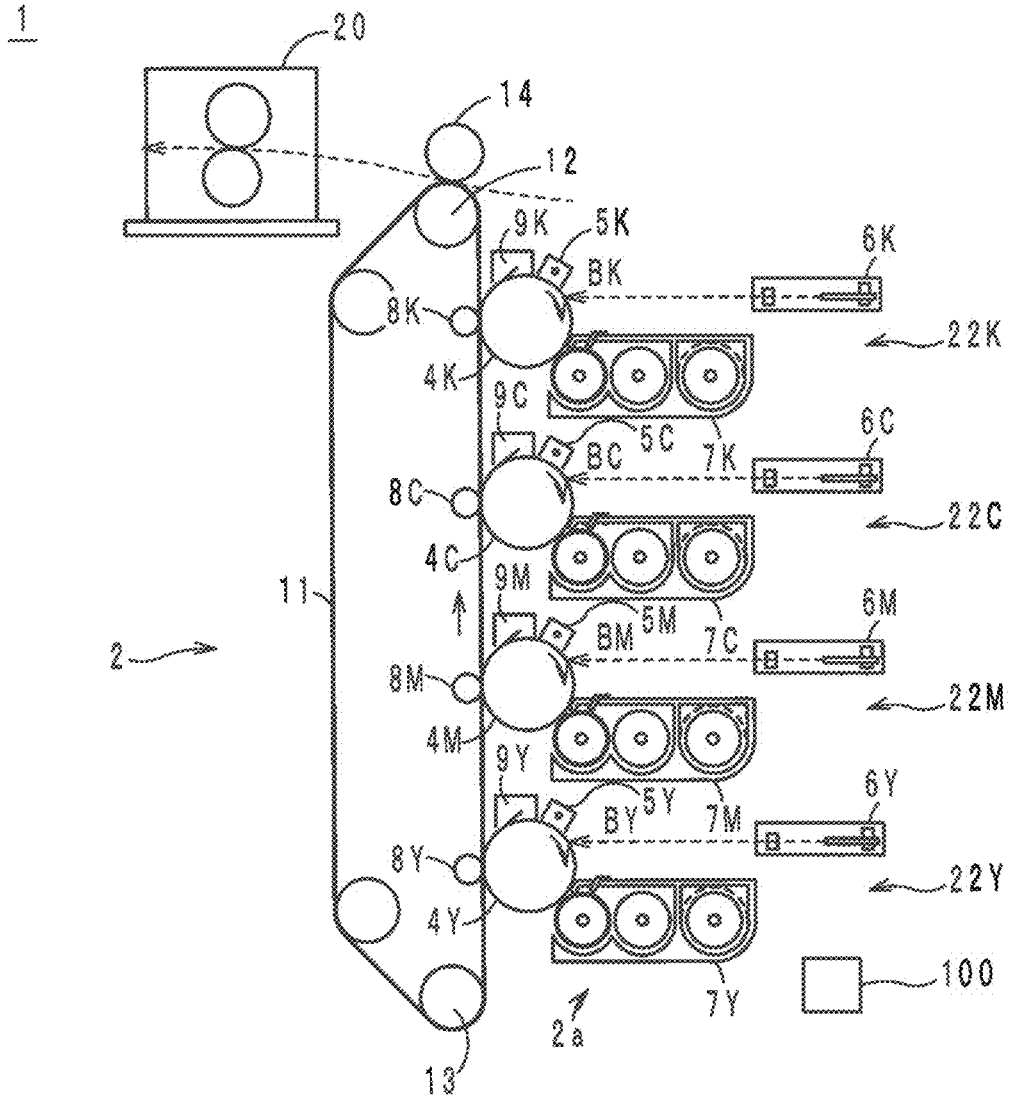
FIG. 1 is a schematic view of an image forming apparatus 1 indicating the general structure thereof.

FIG. 1 is a schematic view of an image forming apparatus 1 indicating the general structure thereof. In FIG. 1, the horizontal direction on the paper surface is referred to as right-left direction, and the depth direction is referred to as front-rear direction. The vertical direction on the paper surface is referred to as up-down direction. The front-rear direction corresponds to a main-scanning direction.

The image forming apparatus 1 is an electrophotographic color printer that is configured to combine images of four colors, namely, yellow (Y), magenta (M), cyan (C) and black (K), in a tandem method. The image forming apparatus 1 has a function to form an image on a sheet (print medium) in accordance with image data read by a scanner, and as illustrated in FIG. 1, the image forming apparatus 1 comprises a printing section 2, a fixing device 20 and a controller 100. A feed cassette, a pair of timing rollers, etc. are omitted from FIG. 2.

The printing section 2 is configured to form a toner image on a sheet fed from the feed cassette. The printing section 2 includes image forming units 22Y, 22M, 22C and 22K, transfer members 8Y, 8M, 8C and 8K, an intermediate transfer belt 11, a driving roller 12, a driven roller 13, and a second transfer roller 14. The image forming units 22Y, 22M, 22C and 22K include photoreceptor drums 4Y, 4M, 4C and 4K, chargers 5Y, 5M, 5C and 5K, optical scanning devices 6Y, 6M, 6C and 6K, developing devices 7Y, 7M, 7C and 7K, and cleaners 9Y, 9M, 9C and 9K, respectively.

The photoreceptor drums 4Y, 4M, 4C and 4K (an example of an image supporting member) are cylindrical. The photoreceptor drums 4Y, 4M, 4C and 4K rotate clockwise in FIG. 1 on their respective rotation axes extending in the front-rear direction. The chargers 5Y, 5M, 5C and 5K charge the peripheral surfaces of the photoreceptor drums 4Y, 4M, 4C and 4K, respectively. Under control of the controller 100, the peripheral surfaces of the photoreceptor drums 4Y, 4M, 4C and 4K are scanned with beams BY, BM, BC and BK emitted from the optical scanning devices 6Y, 6M, 6C and 6K, respectively. Thereby, electrostatic latent images are formed on the peripheral surfaces of the photoreceptor drums 4Y, 4M, 4C and 4K. In sum, the chargers 5Y, 5M, 5C and 5K, and the optical scanning devices 6Y, 6M, 6C and 6K function as electrostatic latent image forming sections serving to form electrostatic latent images on the photoreceptor drums 4Y, 4M, 4C and 4K, respectively.

The developing devices 7Y, 7M, 7C and 7K supply toner to the photoreceptor drums 4Y, 4M, 4C and 4K, respectively, to develop the electrostatic latent images into toner images. The details of the developing devices 7Y, 7M, 7C and 7K will be given later.

The intermediate transfer belt 11 is stretched between the driving roller 12 and the driven roller 13. The toner images developed on the photoreceptor drums 4Y, 4M, 4C and 4K are transferred onto the intermediate transfer belt 11. The transfer members 8Y, 8M, 8C and 8K are arranged to face the inner surface of the intermediate transfer belt 11 and serve to transfer the toner images formed on the photoreceptor drums 4Y, 4M, 4C and 4K onto the intermediate transfer belt 11, thereby forming a composite toner image on the intermediate transfer belt 11 (first transfer). The cleaners 9Y, 9M, 9C and 9K remove toner left on the peripheral surfaces of the photoreceptor drums 4Y, 4M, 4C and 4K after the first transfer. The driving roller 12 is rotated by an intermediate transfer belt drive section (not illustrated in FIG. 1) to drive the intermediate transfer belt 11 to rotate counterclockwise. Accordingly, the intermediate transfer belt 11 carries the composite toner image to the second transfer roller 14.

The second transfer roller 14 is a drum-shaped member facing the intermediate transfer belt 11. When a transfer voltage is applied to the second transfer roller 14, the toner image carried on the intermediate transfer belt 11 is transferred onto a sheet passing through between the second transfer roller 14 and the intermediate transfer belt 11 (second transfer).

The sheet with the toner image transferred thereon is fed to the fixing device 20. In the fixing device 20, the sheet undergoes a heating treatment and a pressing treatment, and the toner image is fixed on the sheet.

The controller 100 is a CPU, for example, and controls operation of the image forming apparatus 1.

Structure of Developing Device

Figure 2:
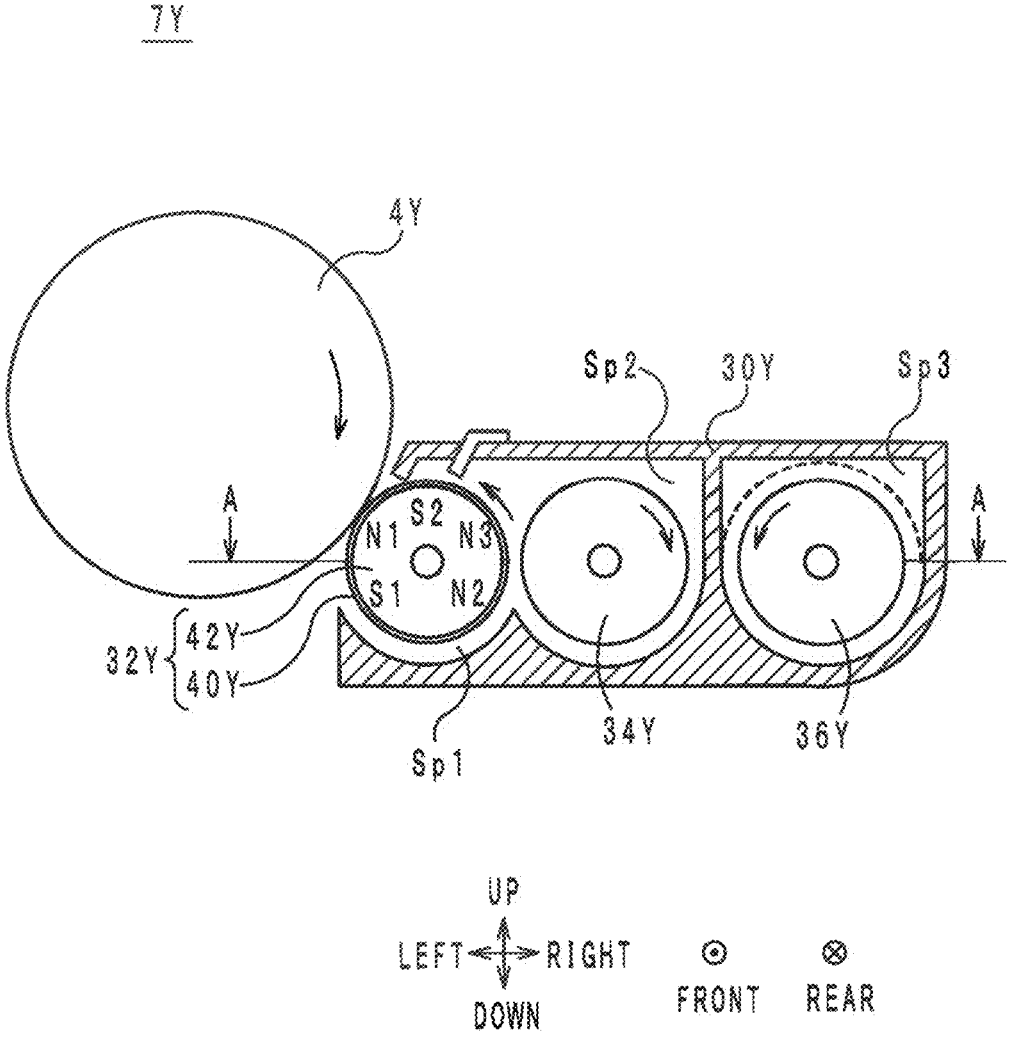
FIG. 2 is a sectional view of a developing device 7Y cut along a surface perpendicular to a front-rear direction.
Figure 3:
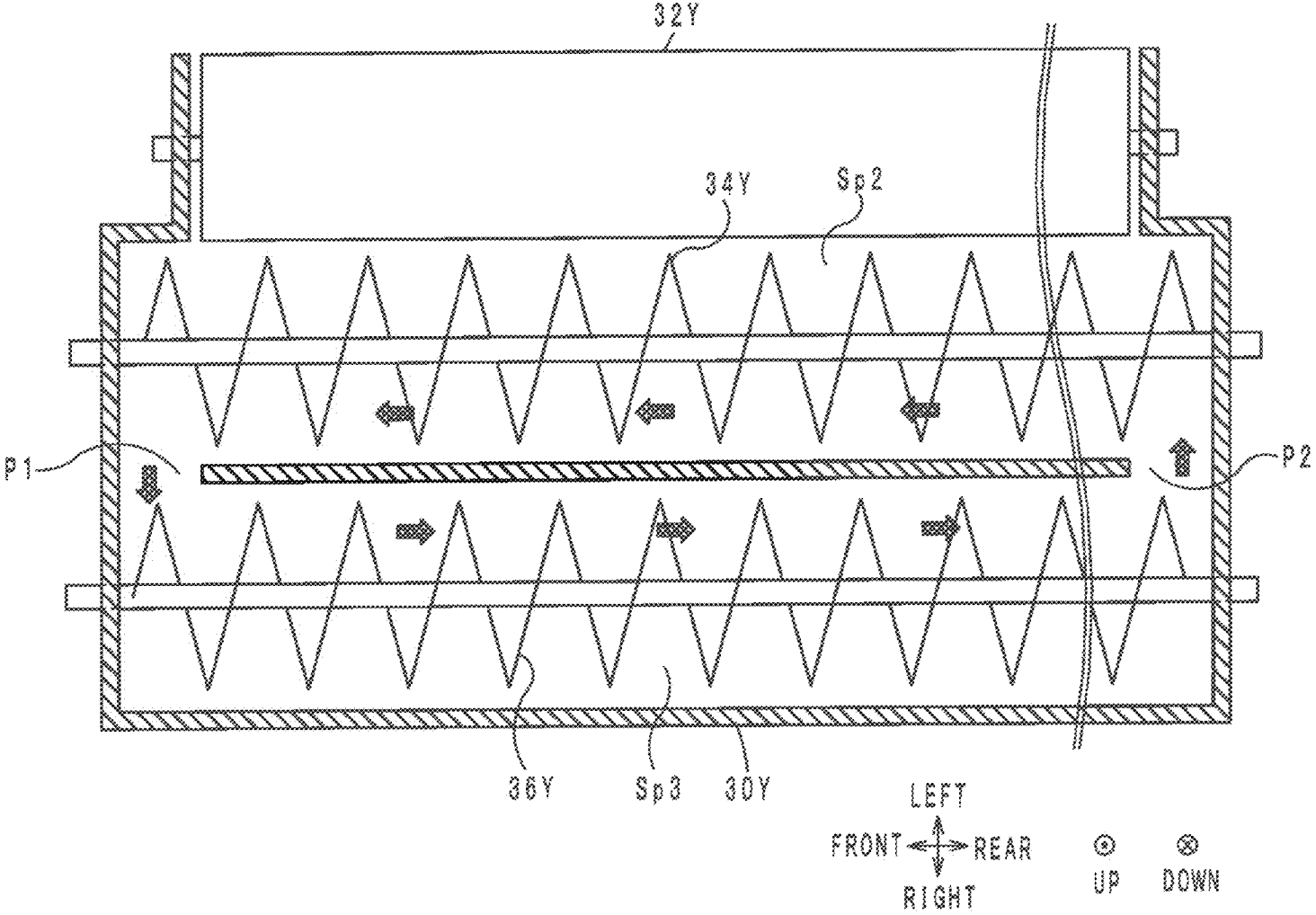
FIG. 3 is a sectional view of the developing device 7A cut along the line A-A in FIG. 2.

Next, the structures of the developing devices 7Y, 7M, 7C and 7K are described with reference to the drawings. The developing devices 7Y, 7M, 7C and 7K have substantially the same structure, and therefore, the structure of the developing device 7Y will hereinafter be described as an example. FIG. 2 is a sectional view of the developing device 7Y cut along a surface perpendicular to the front-rear direction. FIG. 3 is a sectional view of the developing device 7Y cut along the line A-A in FIG. 2.

As seen in FIGS. 2 and 3, the developing device 7Y includes a body 30Y, a developing roller 32Y, and conveyer screws 34Y and 36Y. A developer is contained in the body 30Y. The developer contains toner particles, carrier particles, a polish and an antifriction. The polish is to polish the peripheral surface of the photoreceptor drum 4Y, and consists of microparticles of, for example, silica, titanium oxide, strontium titanate or the like. The antifriction is to lower the coefficient of friction of the photoreceptor drum 4Y, and consists of, for example, zinc stearate, calcium stearate or the like. The polish and the antifriction adhere to the toner particles. The antifriction separates from the toner particles more easily than the polish.

As seen in FIGS. 2 and 3, the body 30Y is substantially in the shape of a rectangular parallelepiped extending in the front-rear direction. In the body 30Y, there are spaces Sp1-Sp3, each of which extends in the front-rear direction, and the spaces Sp1-Sp3 are arranged in this order from left to right. On the left side of the space Sp1, an opening is made. The opening extends in the front-rear direction along the space Sp1.

The spaces Sp1 and Sp2 are adjacent to each other. No partition is provided at the border between the spaces Sp1 and Sp2. The spaces Sp2 and Sp3 are adjacent to each other. A partition is provided at the border between the spaces Sp2 and Sp3. However, in the respective front and rear end portions of the border between the spaces Sp2 and Sp3, no partition is provided. Accordingly, the respective front end portions of the spaces Sp2 and Sp3 are connected together, and the respective rear end portions of the spaces Sp2 and Sp3 are connected together. The front and end portions of the border between the spaces Sp2 and Sp3 where no partition is provided are referred to as connection parts P1 and P2, respectively. Thus, the spaces Sp2 and Sp3 form a looped space when viewed from the top.

The conveyer screw 36Y is provided in the space Sp3 and extends in the front-rear direction. The conveyer screw 36Y conveys the developer toward the rear side (in a predetermined direction) while stirring the developer. The conveyer screw 36Y is driven by a drive source (not illustrated in the drawings) to rotate counterclockwise when viewed from the front side.

The conveyer screw 34Y is provided in the space Sp2 and extends in the front-rear direction. The conveyer screw 34Y conveys the developer toward the front side while stirring the developer. The conveyer screw 34Y is driven by a drive source (not illustrated in the drawings) to rotate clockwise when viewed from the front side.

When the conveyer screws 34Y and 36Y are rotated, the developer circulates in the looped space formed of the spaces Sp2 and Sp3. Specifically, the developer in the space Sp3 is conveyed to the rear side, and the developer flows from the space Sp3 to the space Sp2 through the connection part P2. The developer flowing into the space Sp2 is then conveyed to the front side, and the developer flows from the space Sp2 to the space Sp3 through the connection part P1. Thus, the connection part P2 functions as a supply part that supplies the toner, the polish and the antifriction to the conveyer screw 34Y, and the connection part P1 functions as a supply part that supplies the toner, the polish and the antifriction to the conveyer screw 36Y.

The developing roller 32Y is provided in the space Sp1, and is a cylindrical member extending in the front-rear direction. The developing roller 32Y is exposed to the outside of the body 30Y through the opening made on the left side of the body 30Y. Accordingly, the developing roller 32Y faces the photoreceptor drum 4Y.

No partition is provided at the border between the space Sp1 and the space Sp2. Therefore, the conveyer screw 34Y faces the developing roller 32Y. Accordingly, while conveying the toner, the polish and the antifriction received from the connection part P2 toward the front side, the conveyer screw 34Y supplies the toner, the polish and the antifriction to the developing roller 32Y. The developing roller 32Y supplies the toner, the polish and the antifriction supplied from the conveyer screw 34Y to the photoreceptor drum 4Y, thereby developing the electrostatic latent image on the photoreceptor drum 4Y.

More specifically, the developing roller 32Y includes a sleeve 40Y and a magnet 42Y. The sleeve 40Y is a non-magnetic metal cylinder extending in the front-rear direction, and the sleeve 40Y faces the photoreceptor drum 4Y. The sleeve 40Y is driven to rotate in the opposite direction to the photoreceptor drum 4Y, that is, driven to rotate counterclockwise.

The magnet 42Y is provided inside the sleeve 40Y, and has magnetic poles N1, S1, N2, N3 and S2. The magnetic pole N1 faces the photoreceptor drum 4Y. Then, the magnetic poles N1, S1, N2, N3 and S2 are arranged in this order counterclockwise in the magnet 42Y. The magnet 42Y attracts the carrier particles in the developer, and thereby, the toner, the polish and the antifriction are adsorbed on the peripheral surface of the sleeve 40Y.

In the developing roller 32Y having the structure described above, the carrier particles are attracted to the peripheral surface of the sleeve 40Y by a magnetic field generated between the magnetic poles N3 and S2. In this moment, the toner, the polish and the antifriction adhering to the carrier particles are also attracted to the sleeve 40Y. Thus, the developer is adsorbed on the peripheral surface of the sleeve 40Y and conveyed by the rotation of the sleeve 40Y. In this regard, the developer is kept on the peripheral surface of the sleeve 40Y by a magnetic field generated between the magnetic poles S2 and N1. Meanwhile, the toner, the polish and the antifriction in the developer move from the sleeve 40Y to the photoreceptor drum 4Y by an electric field generated between the photoreceptor drum 4Y and the sleeve 40Y. In this way, a toner image is developed on the photoreceptor drum 4Y.

After passing through between the photoreceptor drum 4Y and the sleeve 40Y, the developer is conveyed while being kept on the sleeve 40Y by a magnetic field generated between the magnetic poles N1 and S1 and a magnetic field generated between the magnetic poles S1 and N2. Thereafter, by a magnetic field between the magnetic poles N2 and N3, the developer is separated from the sleeve 40Y.

Operation of Image Forming Apparatus

Figure 4:
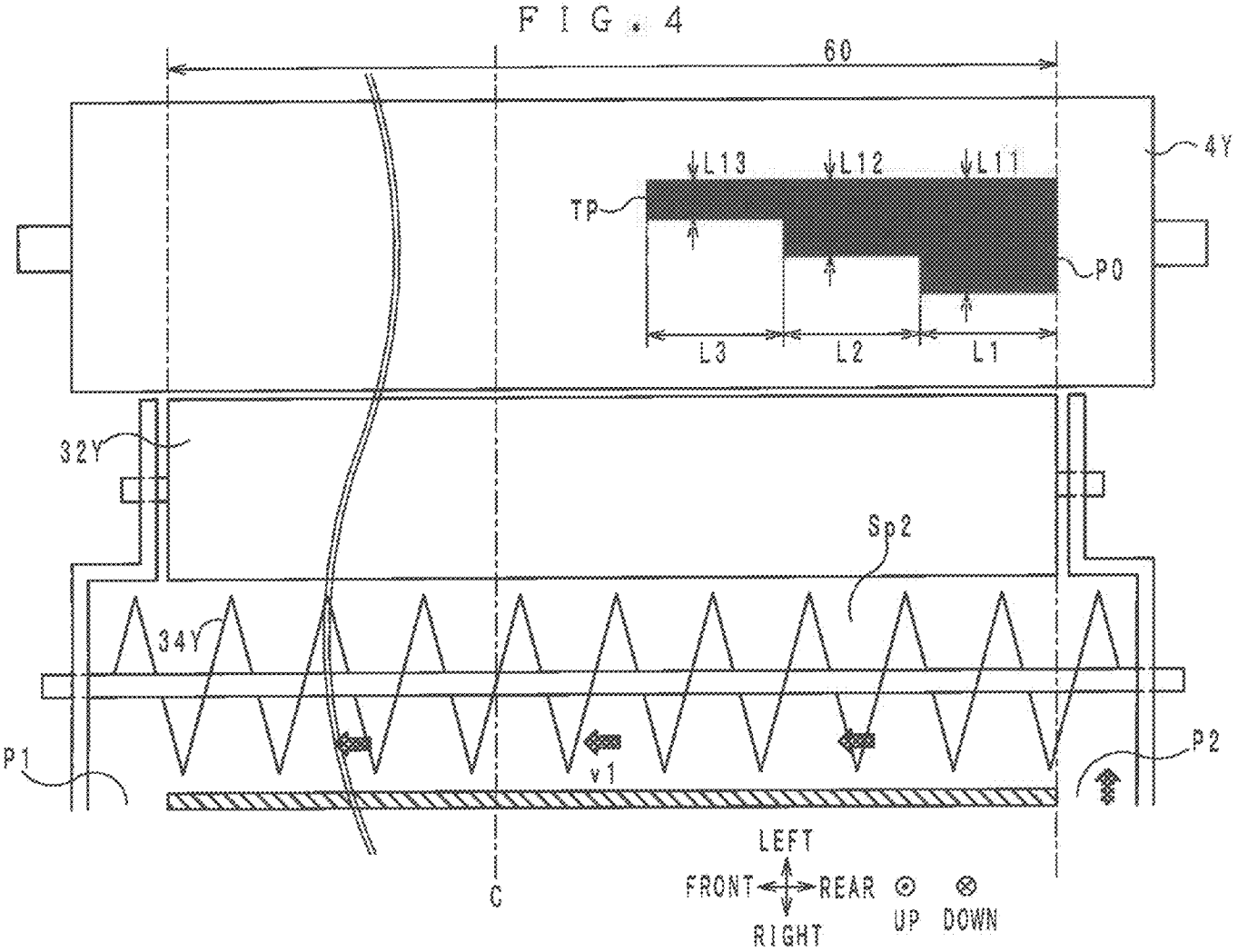
FIG. 4 indicates a toner patch TP formed on a photoreceptor drum 4Y.

Next, operation of the image forming apparatus 1 is described with reference to the drawings. FIG. 4 indicates a toner patch TP formed on the photoreceptor drum 4Y. Since the photoreceptor drum 4Y is cylindrical, the toner patch TP is formed on a cylindrical surface. In FIG. 4, however, for simplicity's sake, the toner patch TP drawn on a plane is shown to overlap the illustration of the photoreceptor drum 4Y. Though toner parches TP are formed on the photoreceptor drums 4M, 4C and 4K as well as on the photoreceptor drum 4Y, descriptions of these toner patches TP on the photoreceptor drums 4M, 4C and 4K will be omitted.

In the image forming apparatus 1, the antifriction separates from the toner particles more easily than the polish. The amount of antifriction contained in the developer kept on the developing roller 32Y decreases with decreasing distance from the front end (the downstream end in the developer conveying direction). Accordingly, the amount of antifriction adhering to the photoreceptor drum 4Y decreases with decreasing distance from the front end. Consequently, the coefficient of friction of the photoreceptor drum 4Y becomes higher with decreasing distance from the front end.

In the image forming apparatus 1, the controller 100 drives the charger 5Y, the optical scanning device 6Y, the developing device 7Y to form a toner patch TP on the photoreceptor drum 4Y periodically. At this time, the toner patch TP is not transferred to the intermediate belt 11, and the cleaner 9Y is driven to remove the toner patch TP from the photoreceptor drum 4Y. A detailed description of the toner patch TP will be given below.

The toner patch TP is formed in a facing area 60 of the photoreceptor drum 4Y so as to extend from a predetermined point P0 closest to the connection part P2 toward the front end (in a predetermined direction). In the toner patch TP, the amount of toner adhering to the photoreceptor drum 4Y decreases with increasing distance from the predetermined point P0 and with decreasing distance from the front end. The facing area 60 is a portion of the photoreceptor drum 4Y that faces the developing roller 32Y while the photoreceptor drum 4Y is rotating. In other words, the facing area 60 is a portion of the photoreceptor drum 4Y overlapping the developing roller 32Y when viewed in the right-left direction. The toner, the polish and the antifriction are supplied from the developing roller 32Y to the facing area 60 by the developing roller 32Y. The connection part P2 is located in the rear side of the developing roller 32Y in the front-rear direction. Accordingly, the predetermined point P0 is a point of the photoreceptor drum 4Y facing the rear end (the end in a direction opposite to the predetermined direction) of the developing roller 32Y, that is, the rear end of the facing area 60. For simplicity's sake, the predetermined point P0 is defined as the zero point in the front-rear direction. The direction toward the front side will be referred to as a positive direction, and the direction toward the rear side will be referred to as a negative direction.

In a portion from the predetermined point P0 (from the zero point) to a point at a distance of L1 from the zero point (to a point L1), the dimension of the toner patch TP in the rotating direction of the photoreceptor drum 4Y (that is, a direction opposite to the sub-scanning direction) is L11. In a portion from the point L1 to a point at a distance of L1+L2 from the zero point (to a point L1+L2), the dimension of the toner patch TP in the rotating direction of the photoreceptor drum 4Y is L12. In a portion from the point L1+L2 to a point at a distance of L1+L2+L3 from the zero point (to a point L1+L2+L3), the dimension of the toner patch TP in the rotating direction of the photoreceptor drum 4Y is L13. Here, the dimensions L11, L12 and L13 meet the condition of L11>L12>L13, and the distances L1, L2 and L3 meet the condition of L1=L2=L3. Therefore, the toner patch TP is in a staircase pattern, and the toner patch TP has such a shape that the amount of toner adhering to the photoreceptor drum 4Y decreases with increasing distance from the predetermined point P0 and with decreasing distance from the front end. In this embodiment, the toner patch TP has a uniform toner density. The toner density is the amount of toner adhering to a unit area.

The toner patch TP is formed in the rear portion of the photoreceptor drum 4Y from the center C with respect to the front-rear direction. The toner parch TP is not formed in the front portion of the photoreceptor drum 4Y from the center C with respect to the front-rear direction.

The toner patch TP is formed on the photoreceptor drum 4Y in a period when image formation on sheets is not carried out, for example, during operation for image stabilization. The toner patch TP is scraped by a blade of the cleaner 9Y.

Effects

In the image forming apparatus 1 having the structure above, the film thickness of a photosensitive layer of the photoreceptor drum 4Y (which will be referred to simply as film thickness of the photoreceptor drum 4Y) is prevented from becoming non-uniform. More specifically, a toner patch TP having such a shape that the amount of toner adhering to the photoreceptor drum 4Y decreases with increasing distance from the predetermined point P0 and with decreasing distance from the front end is formed. The toner patch TP contains a large amount of polish, and the amount of polish on the photoreceptor drum 4Y decreases with increasing distance from the predetermined point P0 and with decreasing distance from the front end. Meanwhile, the amount of antifriction held on the photoreceptor drum 4Y is larger with decreasing distance from the rear end. Thus, with the formation of the toner patch TP, a large amount of polish adheres to a portion of the photoreceptor drum 4Y where a large amount of antifriction adheres, and a small amount of antifriction (or no antifriction) adheres to a portion of the photoreceptor drum 4Y where a small amount of antifriction adheres. When the toner patch TP is removed by the cleaner 9Y, the polish in the toner patch TP removes the antifriction. Therefore, as the amount of polish increases, the amount of antifriction removed increases. Thereby, the amount of antifriction adhering to the photoreceptor drum 4Y gets close to constant regardless of the point in the front-rear direction. Accordingly, the coefficient of friction of the photoreceptor drum 4Y gets close to constant regardless of the point in the front-rear direction. Thus, the film thickness of the photoreceptor drum 4Y is prevented from becoming non-uniform.

In order to confirm the effect brought by the image forming apparatus 1, the inventors conducted an experiment as follows. As a first sample, 1000 sheets were printed with no toner patch TP formed, and thereafter, the coefficient of friction of the photoreceptor drum was measured. As a second sample, 1000 sheets were printed while the toner patch TP was formed, and thereafter, the coefficient of friction of the photoreceptor drum was measured. In the second sample, every time 100 sheets were printed, the toner patch TP was formed. The first sample corresponds to a comparative example, and the second sample corresponds to the embodiment. The length (dimension in the front-rear direction) of the toner patch TP was 100 mm.

Figure 5:
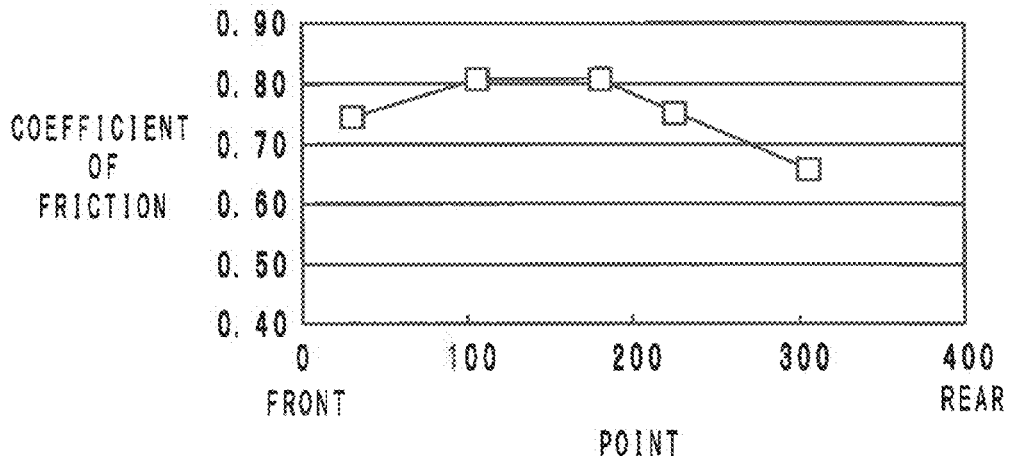
FIG. 5 is a graph indicating uniformity (or non-uniformity) of coefficient of friction of a first sample.
Figure 6:
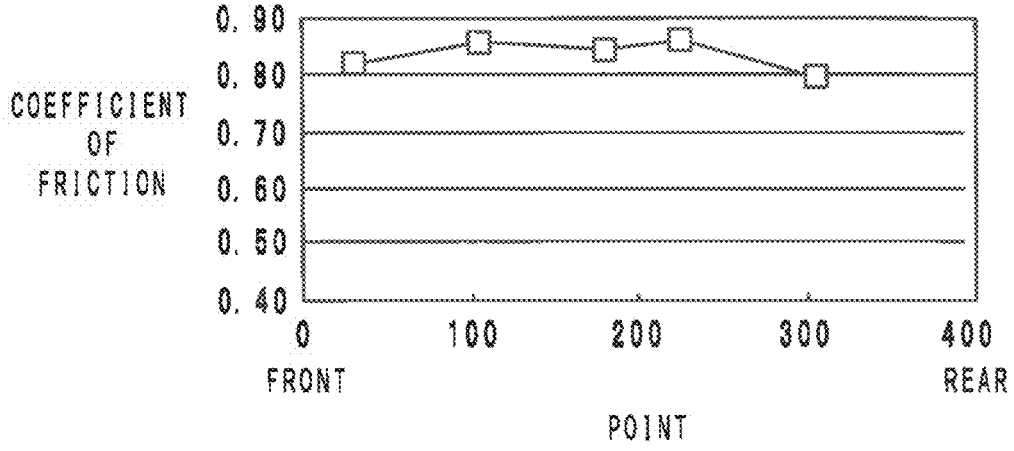
FIG. 6 is a graph indicating uniformity (or non-uniformity) of coefficient of friction of a second sample.

FIG. 5 is a graph indicating the uniformity (or the non-uniformity) of the coefficient of friction of the first sample, and FIG. 6 is a graph indicating the uniformity (or the non-uniformity) of the coefficient of friction of the second sample. In FIGS. 5 and 6, the y-axis indicates the coefficient of friction, and the x-axis indicates the point on the photoreceptor drum.

As seen in FIG. 5, in the first sample, the coefficient of friction decreases sharply in the portion from 200 mm to 300 mm. This shows that the amount of antifriction in the portion from 200 mm to 300 m is larger than that in the portion from 0 mm to 200 mm. In the first sample, therefore, the abrasion of the photoreceptor drum in the portion 0 mm to 200 mm is heavier than that in the portion 200 mm to 300 mm. Consequently, the film thickness of the photoreceptor drum becomes non-uniform.

As seen in FIG. 6, in the second sample, the coefficient of friction is uniform, and this is attributed to the formation of the toner patch TP. Consequently, in the second sample, the film thickness of the photoreceptor drum is uniform.

In the image forming apparatus 1, the toner patch TP is formed in the rear portion of the photoreceptor drum 4Y from the center C with respect to the front-rear direction, and no toner patch is formed in the front portion of the photoreceptor drum 4Y from the center C with respect to the front-rear direction. Thus, the toner patch TP is formed only in a necessary portion, thereby resulting in a reduction in the toner consumption. This, however, does not mean to prohibit the formation of the toner patch TP in the front portion of the photoreceptor drum 4Y.

In the image forming apparatus 1, the connection part P2 is located on the rear side of the developing roller 32Y, and the connection part P1 is located on the front side of the developing roller 32Y. Thereby, the developer can be supplied to the developing roller 32Y entirely from the rear end to the front end. Consequently, it is possible to control the coefficient of friction in the entire facing area 60 of the photoreceptor drum 4Y.

First Modification

Figure 7:
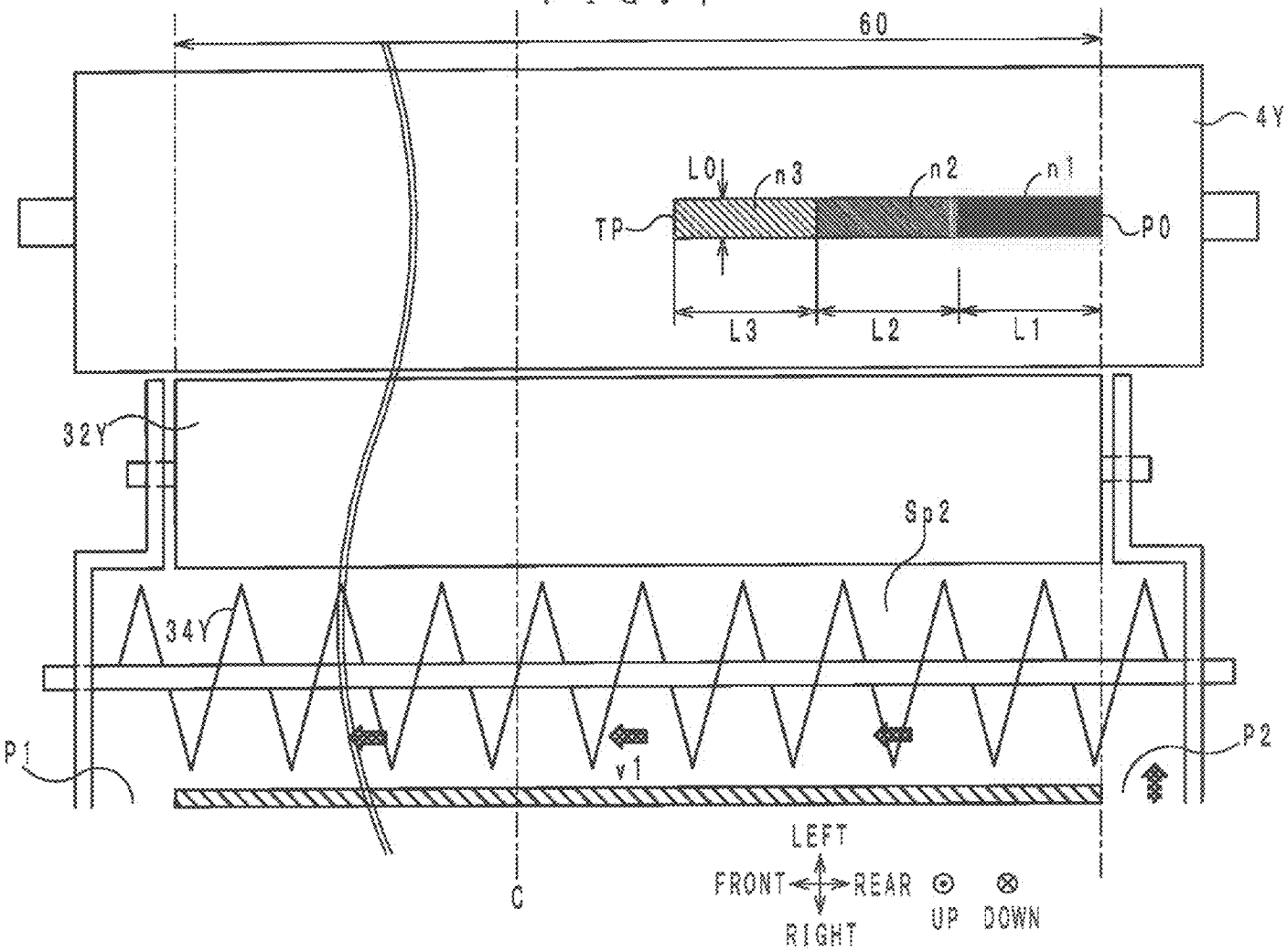
FIG. 7 indicates a toner patch TP formed on the photoreceptor drum 4Y.

An image forming apparatus 1*a* according a first modification will hereinafter be described with reference to the drawings. FIG. 7 indicates a toner patch TP formed on the photoreceptor drum 4Y.

The image forming apparatus 1*a* differs from the image forming apparatus 1 in the structure of the toner patch TP. The following description of the image forming apparatus 1*a* focuses on the structure of the toner patch TP.

The toner patch TP is only required to have such a structure that the amount of toner adhering to the photoreceptor drum 4Y decreases with increasing distance in the predetermined direction from the predetermined point P0, which is the closest point to the connection part P2, in the facing area 60 facing the developing roller 32Y and with decreasing distance from the front end. In the image forming apparatus 1*a*, therefore, the toner density of the toner patch TP becomes lower with increasing distance from the predetermined point P0 and with decreasing distance from the front end.

Specifically, in the portion from the predetermined point P0 to the point L1, the toner density of the toner patch TP is n1. In the portion from the point L1 to the point L1+L2, the toner density of the toner patch TP is n2. In the portion from the point L1+L2 to the point L1+L2+L3, the toner density of the toner patch TP is n3. Here, the values n1, n2 and n3 meet the condition of n1>n2>n3, and the distances L1, L2 and L3 meet the condition of L1=L2=L3. Thus, the toner density of the toner patch TP becomes lower step by step with increasing distance from the predetermined position and with decreasing distance from the front end. Accordingly, in the toner patch TP, the amount of toner adhering to the photoreceptor drum 4Y decreases with increasing distance from the predetermined point and with decreasing distance from the front end. The dimension of the toner patch TP in the rotating direction of the photoreceptor drum 4Y is constantly L0.

The image forming apparatus 1*a* has the same effects as the image forming apparatus 1.

Further, even in an image forming apparatus that cannot form a toner patch having a complicating shape, such as a staircase shape, the film thickness of the photoreceptor drum 4Y is prevented from becoming non-uniform. Also, the toner patch TP can be made smaller.

Second Modification

Figure 8A:
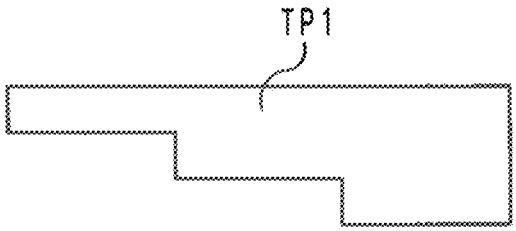
FIG. 8A indicates a toner patch TP1.
Figure 8B:
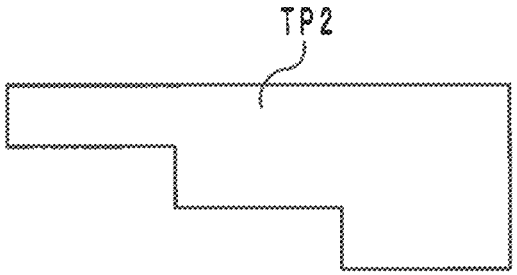
FIG. 8B indicates a toner patch TP2.
Figure 8C:
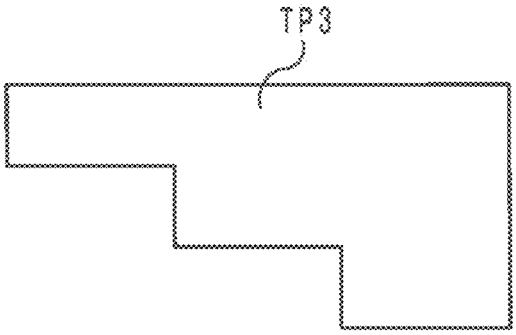
FIG. 8C indicates a toner patch TP3.

An image forming apparatus 1*b* according to a second modification will hereinafter be described with reference to the drawings. FIGS. 8A-8C indicate toner patches TP1-TP3, respectively.

In the image forming apparatus 1*b*, the amount of toner used to form a toner patch TP is changed in accordance with the number of sheets printed by use of the developing device 7Y. Specifically, until the number of sheets printed by use of the developing device 7Y reaches 20000 (in an early stage of use of the developing device), the toner patch TP1 as indicated in FIG. 8A is formed with the least amount of toner. While the number of sheets printed by use of the developing device 7Y is within 20001 to 40000 (in a middle stage of use of the developing device), the toner patch TP2 as indicated in FIG. 8B is formed with the second least amount of toner. After the number of sheets printed by use of the developing device 7Y has reached 40001 (in a late stage of use of the developing device), the toner patch TP3 as indicated in FIG. 8C with the most amount of toner. Thus, in the image forming apparatus 1*b*, as the number of sheets printed by use of the developing device 7Y is increasing, the amount of toner used to form a toner patch TP is increased.

Some of the existing developing devices 7Y are of a type which does not supply the same amount of antifriction to the photoreceptor drum 4Y all through from its early stage of use to its late stage of use. For example, as the developing device 7Y proceeds from its early stage of use to its late stage of use, the amount of antifriction supplied from the developing device 7Y to the photoreceptor drum 4Y increases. In order to cope with this situation, in the image forming apparatus 1*b*, as the developing device 7Y proceeds from its early stage of use to its late stage of use, the amount of toner used to form a toner patch TP is increased. Accordingly, as the developing device 7Y proceeds from its early stage of use to its late stage of use, the amount of antifriction supplied to the photoreceptor drum 4Y with the formation of the toner patch TP is increased. Consequently, it is possible to maintain the coefficient of friction of the photoreceptor drum 4Y almost uniform in the front-rear direction all through from the early stage of use of the developing device 7Y to the late state of use of the developing device 7Y.

In a case in which the developing device 7Y is of a type which supplies less amount of antifriction to the photoreceptor drum 4Y with progression from its early stage of use to its late stage of use, the amount of toner used to form a toner patch shall be decreased as the developing device 7Y proceeds from its early stage of use to its late stage of use.

Also, the image forming apparatus 1*b* can be adapted to a type of developing device 7Y which causes changes of the state of antifriction adhering to the photoreceptor drum 4Y with progression from its early stage of use to its late stage of use.

Third Modification

An image forming apparatus 1*c* according to a third modification will hereinafter be described.

In the image forming apparatus 1*c*, the frequency of formation of the toner patch TP is changed in accordance with the number of sheets printed by use of the developing device 7Y. Specifically, until the number of sheets printed by use of the developing device 7Y reaches 20000 (in an early stage of use of the developing device), the toner patch TP is formed every time 2000 sheets have been printed. While the number of sheets printed by use of the developing device 7Y is within 20001 to 40000 (in a middle stage of use of the developing device), the toner patch TP is formed every time 1500 sheets have been printed. After the number of sheets printed by use of the developing device 7Y has reached 40001 (in a late stage of use of the developing device), the toner patch TP is formed every time 1000 sheets have been printed. Thus, in the image forming apparatus 1*c*, as the number of sheets printed by use of the developing device 7Y increases, the frequency of formation of the toner patch TP is heightened.

Some of the existing developing devices 7Y are of a type which does not supply the same amount of antifriction to the photoreceptor drum 4Y all through from its early stage of use to its late stage of use. For example, as the developing device 7Y proceeds from its early stage of use to its late stage of use, the amount of antifriction supplied from the developing device 7Y to the photoreceptor drum 4Y increases. In order to cope with this situation, in the image forming apparatus 1*c*, as the developing device 7Y proceeds from its early stage of use to its late stage of use, the frequency of formation of the toner patch TP is heightened. Accordingly, as the developing device 7Y proceeds from its early stage of use to its late stage of use, the amount of antifriction supplied to the photoreceptor drum 4Y with the formation of the toner patch TP is increased. Consequently, the coefficient of friction of the photoreceptor drum 4Y can be maintained almost uniform in the front-rear direction all through from the early stage of use of the developing device 7Y to the late state of use of the developing device 7Y.

In a case in which the developing device 7Y is of a type which supplies less amount of antifriction to the photoreceptor drum 4Y with progression from its early stage of use to its late stage of use, the frequency of formation of the toner patch TP shall be lowered as the developing device 7Y proceeds from its early stage of use to its late stage of use.

Also, the image forming apparatus 1*c* can be adapted to a type of developing device 7Y which causes changes of the state of antifriction adhering to the photoreceptor drum 4Y with progression from its early stage of use to its late stage of use.

Fourth Modification

Figure 9:
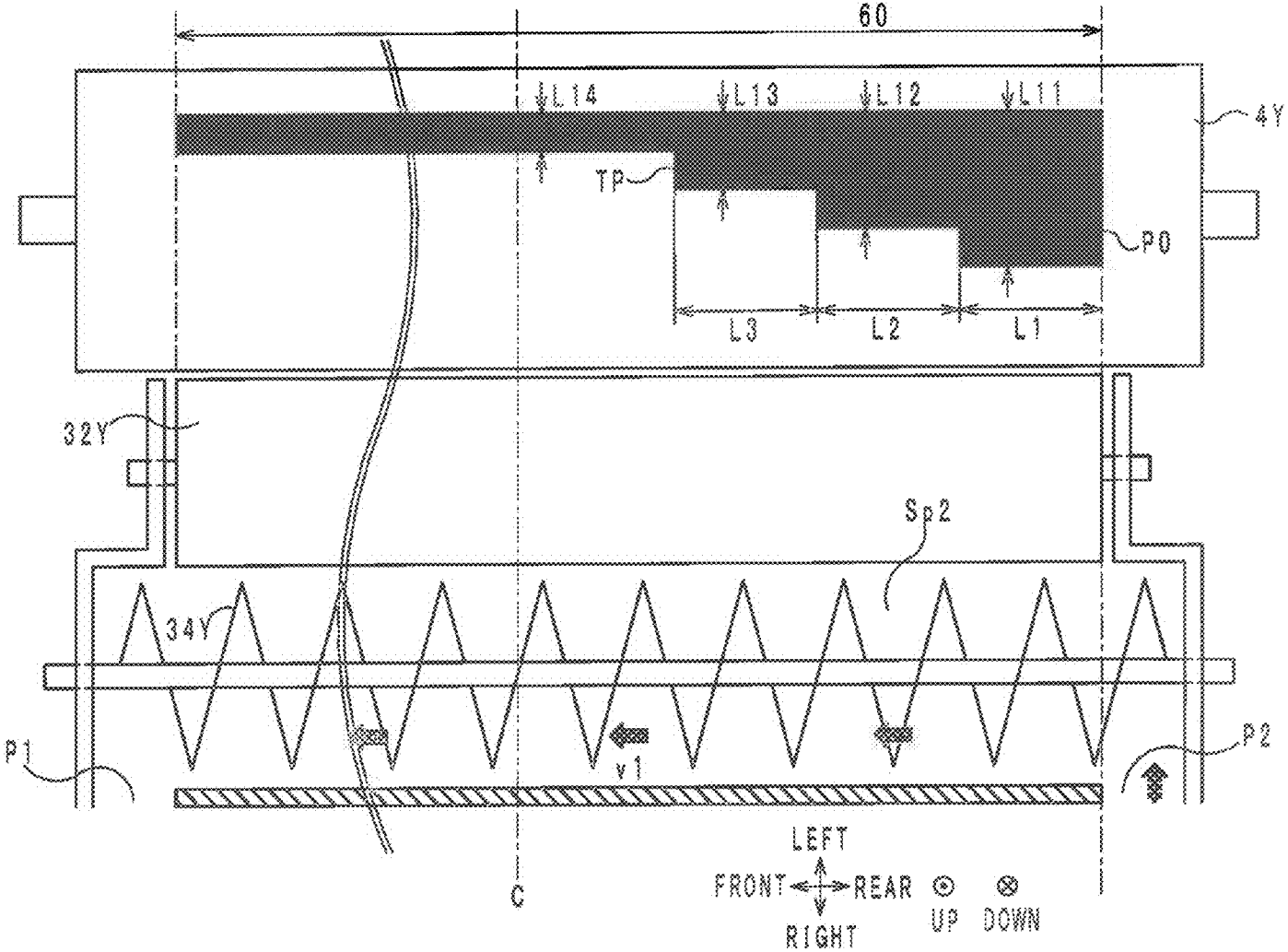
FIG. 9 indicates a toner patch TP formed on the photoreceptor drum 4Y.
Figure 10:
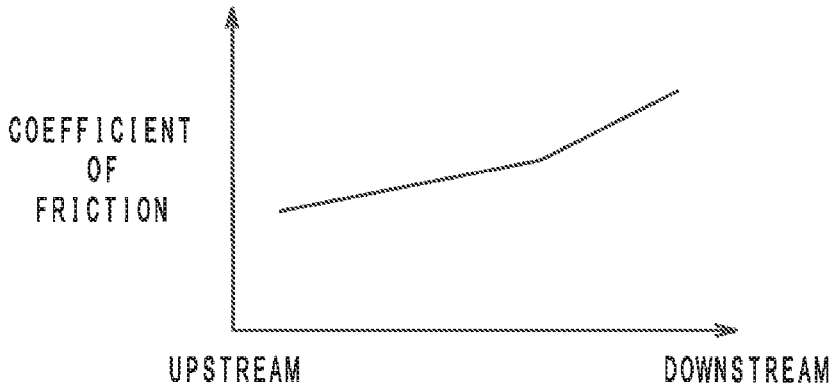
FIG. 10 is a graph indicating the relation between the point on an image supporting member and the coefficient of friction.
Figure 11:
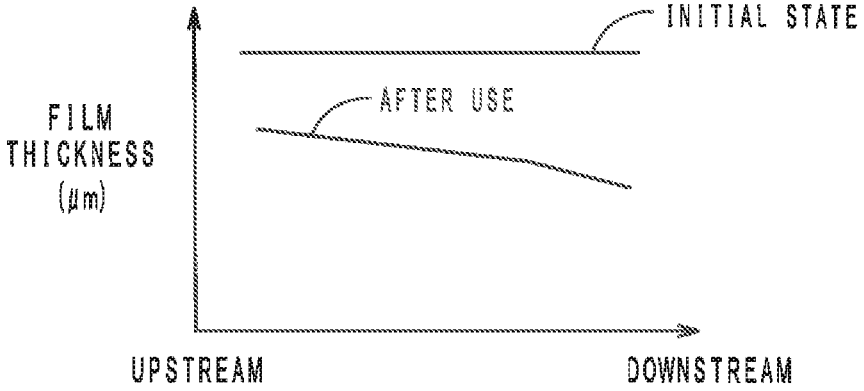
PRIOR ART FIG. 11
FIG. 11 is a graph indicating the relation between the point on an image supporting member and the film thickness.

An image forming apparatus 1*d* according to a fourth modification will hereinafter be described with reference to the drawings. FIG. 9 indicates a toner patch TP to be formed on the photoreceptor drum 4Y.

The image forming apparatus 1*d* differs from the image forming apparatus 1 in the structure of the toner patch TP. The following description focuses on the structure of the toner patch TP.

In the fourth modification, the toner patch TP extends throughout the length of the facing area 60 (from the front end to the rear end of the facing area 60) of the photoreceptor drum 4Y. Specifically, in the portion from the predetermined point P0 to the point L1, the dimension of the toner patch TP in the rotating direction of the photoreceptor drum 4Y is L11. In the portion from the point L1 to the point L1+L2, the dimension of the toner patch TP in the rotating direction of the photoreceptor drum 4Y is L12. In the portion from the point L1+L2 to the point L1+L2+L3, the dimension of the toner patch TP in the rotating direction of the photoreceptor drum 4Y is L13. In the portion from the point L1+L2+L3 to the front end of the facing area 60, the dimension of the toner patch TP in the rotating direction of the photoreceptor drum 4Y is L14. Here, the values L11, L12, L13 and L14 meet the condition of L11>L12>L13>L14, and the distances L1, L2 and L3 meet the conditions of L1=L2=L3. In this modification, the toner patch TP has a uniform toner density.

The image forming apparatus 1*d* has the same effects as the image forming apparatus 1.

In the fourth modification, the toner patch TP extends throughout the length of the facing area 60 (from the front end to the rear end of the facing area 60) of the photoreceptor drum 4Y. Therefore, the toner patch TP can also serve to prevent curls of the blade of the cleaner 9Y. Accordingly, it is not necessary to form a toner patch in another process only to prevent curls of the blade of the cleaner 9Y.

Other Embodiments

Image forming apparatuses according to the present invention are not limited to the image forming apparatuses 1 and 1*a*-1*d* described above.

The toner patch TP formed in the image forming apparatus 1 is in a staircase pattern having three steps. However, the toner patch TP may be in a staircase pattern having four or more steps. Also, the toner patch TP does not need to have such a shape that the amount of toner adhering to the photoreceptor drum 4Y decreases step by step with increasing distance from the predetermined point P0 and with decreasing distance from the front end, and the toner patch TP may have such a shape that the decrease in the amount of toner may be in a continuous fashion. For example, the toner patch TP may be triangular. By varying the amount of toner step by step at shorter intervals or in a continuous fashion, it becomes possible to vary the amount of polish supplied to the photoreceptor drum 4Y step by step at shorter intervals or in a continuous fashion. Consequently, the prevention of non-uniformity in the film thickness of the photoreceptor drum 4Y becomes more effective.

In the image forming apparatus 1*b*, the amount of toner used to form a toner patch TP is changed in accordance with the number of sheets printed by use of the developing device 7Y. In other words, in the image forming apparatus 1*b*, the amount of toner used to form a toner patch TP is changed in accordance with the total number of rotations of the developing roller 32Y of the developing device 7Y. The number of sheets printed by use of the developing device 7Y shows an example of the total number of rotations of the developing roller 32Y of the developing device 7Y.

In the image forming apparatus 1*c*, the frequency of formation of the toner patch TP is changed in accordance with the number of sheets printed by use of the developing device 7Y. In other words, in the image forming apparatus 1*c*, the frequency of formation of the toner patch TP is changed in accordance with the total number of rotations of the developing roller 32Y of the developing device 7Y. The number of sheets printed by use of the developing device 7Y shows an example of the total number of rotations of the developing roller 32Y of the developing device 7Y.

In the image forming apparatuses 1 and 1*a*-1*d*, the connection part P2 is located on the rear side of the developing roller 32Y. The location of the connection part P2 is not limited to this case. For example, the connection part P2 may be located in the center of the developing roller 32Y with respect to the front-rear direction. In this case, two conveying screws 34Y shall be provided. One of the conveying screws 34Y conveys the developer from the connection part P2 toward the front end, and the other conveying screw 34Y conveys the developer from the connection part P2 toward the rear end. In this case, it is necessary to form two toner patches TP11 and TP12 on the photoreceptor drum 4Y, in the facing area 60 facing the developing roller 32Y. The toner patch TP11 is formed to extend from a predetermined point P0 closest to the connection part P2 toward the front end. The toner patch TP11 has such a structure that the amount of toner adhering to the photoreceptor drum 4Y decreases with increasing distance from the predetermined point P0 and with decreasing distance from the front end. The toner patch TP12 is formed to extend from the predetermined point P0 closest to the connection part P2 toward the rear end. The toner patch TP12 has such a structure that the amount of toner adhering to the photoreceptor drum 4Y decreases with increasing distance from the predetermined point P0 and with decreasing distance from the rear end.

The structures of the image forming apparatuses 1 and 1*a*-1*d* may be combined.

Although the present invention has been described in connection with the preferred embodiments above, it is to be noted that various changes and modifications may be obvious to those who are skilled in the art. Such changes and modifications are to be understood as being within the scope of the invention.

What is claimed is:

1. An image forming apparatus comprising:

an image supporting member configured to rotate on a rotation axis extending in a predetermined direction;

an electrostatic latent image forming section configured to form an electrostatic latent image on the image supporting member;

a developing device including a body, a developing roller facing the image supporting member, and a supply member facing the developing roller, the body containing toner, a polish serving to polish the image supporting member and an antifriction serving to lower a coefficient of friction of the image supporting member;

a cleaner; and a controller, wherein:

in the body of the developing device, a supply part where the toner, the polish and the antifriction are supplied to the supply member is provided;

the supply member supplies the toner, the polish and the antifriction the supply member received at the supply part to the developing roller while conveying the toner, the polish and the antifriction in the predetermined direction;

the developing roller develops the electrostatic latent image by supplying the toner, the polish and the antifriction received from the supply member to the image supporting member;

the controller drives the electrostatic latent image forming section and the developing device to form a toner patch on the image supporting member, in a facing area capable of facing the developing roller, such that an amount of toner adhering to the image supporting member decreases with increasing distance in the predetermined direction from a predetermined point closest to the supply part with respect to the predetermined direction; and the cleaner removes the toner patch from the image supporting member.

2. The image forming apparatus according to claim 1, wherein a dimension of the toner patch in a rotating direction of the image supporting member becomes smaller with increasing distance in the predetermined direction from the predetermined point.

3. The image forming apparatus according to claim 1, wherein a toner density of the toner patch becomes lower with increasing distance in the predetermined direction from the predetermined point.

4. The image forming apparatus according to claim 1, wherein the controller changes the amount of toner used to form the toner patch in accordance with a total number of rotations of the developing roller.

5. The image forming apparatus according to claim 1, wherein the controller changes the frequency of toner patch formation in accordance with a total number of rotations of the developing roller.

6. The image forming apparatus according to claim 1, wherein the toner patch is formed in a portion farther in a direction opposite to the predetermined direction from a center of the image supporting member with respect to the predetermined direction.

7. The image forming apparatus according to claim 1, wherein the toner patch is formed on the image supporting member to extend from an end of the facing area to the other end of the facing area in the predetermined direction.

8. The image forming apparatus according to claim 1, wherein:

the antifriction and the polish adhere to the toner; and the antifriction separates from the toner more easily than the polish.

9. The image forming apparatus according to claim 1, wherein the predetermined point is a point on the image supporting member facing an end of the developing roller in a direction opposite to the predetermined direction.

* * * * *